US008322320B2

(12) United States Patent
Oledzki

(10) Patent No.: US 8,322,320 B2
(45) Date of Patent: Dec. 4, 2012

(54) LASER IGNITION DEVICE FOR COMBUSTION ENGINE

(76) Inventor: Wieslaw Oledzki, Lowicz (PL)

( * ) Notice: Subject to any disclaimer, the term of this patent is extended or adjusted under 35 U.S.C. 154(b) by 265 days.

(21) Appl. No.: 12/922,423

(22) PCT Filed: Jan. 20, 2009

(86) PCT No.: PCT/PL2009/000005

§ 371 (c)(1),
(2), (4) Date: Oct. 27, 2010

(87) PCT Pub. No.: WO2009/116879

PCT Pub. Date: Sep. 24, 2009

(65) Prior Publication Data

US 2011/0061623 A1 Mar. 17, 2011

(30) Foreign Application Priority Data

Mar. 17, 2008 (PL) ..... 384721

(51) Int. Cl.
*F02P 23/04* (2006.01)

(52) U.S. Cl. ..... 123/143 B

(58) Field of Classification Search ..... 123/143 B
See application file for complete search history.

(56) References Cited

U.S. PATENT DOCUMENTS

| | | | | |
|---|---|---|---|---|
| 4,416,226 | A | 11/1983 | Nishida et al. | |
| 7,040,270 | B2 * | 5/2006 | Herdin et al. | 123/143 B |
| 7,499,477 | B2 * | 3/2009 | Winklhofer et al. | 372/10 |
| 7,770,552 | B2 * | 8/2010 | Schultz | 123/143 B |
| 7,793,631 | B2 * | 9/2010 | Niwa et al. | 123/143 B |
| 7,806,094 | B2 * | 10/2010 | Gruber | 123/143 B |
| 8,127,732 | B2 * | 3/2012 | Kopecek et al. | 123/143 B |
| 8,181,617 | B2 * | 5/2012 | Kuhnert et al. | 123/143 B |
| 2003/0136366 | A1 * | 7/2003 | Herdin et al. | 123/143 B |
| 2007/0068475 | A1 * | 3/2007 | Kopecek et al. | 123/143 B |
| 2008/0257294 | A1 | 10/2008 | Vogel et al. | |
| 2008/0264371 | A1 * | 10/2008 | Taido et al. | 123/143 B |
| 2009/0159033 | A1 * | 6/2009 | Steigleman et al. | 123/143 B |

(Continued)

FOREIGN PATENT DOCUMENTS

DE 2 207 392 A1 8/1973

(Continued)

*Primary Examiner* — Erick Solis
(74) *Attorney, Agent, or Firm* — Marsh Fischmann & Breyfogle LLP

(57) ABSTRACT

The invention provides a laser ignition device for a combustion engine, especially a four-stroke engine, powered by ethyl alcohol, methyl alcohol and petrol, kerosene and benzol (benzene). The device of the invention is provided, in addition to a pulse laser, with a housing (10), at the outlet of which a quartz window (11) is seated, with a control-operation system (18) and with a dumper (15) seated in the bottom (3.1) of the piston (3) of the engine cylinder (2). The operation surface of the dumper (15) is heated in pulses by the laser radiation beam and said heated up operation surface of the dumper (15) causes ignition when the fuel mix reaches its lower explosion range limit. When the amount of fuel in the mix increases, the loss of laser beam radiation in a gas cushion between the quartz window (11) and the dumper (15) increases exponentially, according to the Beer-Lambert-Bouguer rule, and at some specific concentration the temperature in the axis of the laser beam reaches a self-ignition point, which causes propagation of ignition to the gas cushion. In another embodiment, the dumper (15) is seated in two arms (14) fixed to an outer sleeve of the laser housing (10).

4 Claims, 2 Drawing Sheets

U.S. PATENT DOCUMENTS

| | | | | |
|---|---|---|---|---|
| 2010/0275868 | A1* | 11/2010 | Herden et al. | 123/143 B |
| 2012/0024251 | A1* | 2/2012 | Weinrotter et al. | 123/143 B |
| 2012/0037108 | A1* | 2/2012 | Herden et al. | 123/143 B |
| 2012/0210969 | A1* | 8/2012 | Gruber et al. | 123/143 B |

FOREIGN PATENT DOCUMENTS

| | | | |
|---|---|---|---|
| DE | 10 2006 000 097 | A1 | 9/2006 |
| DE | 10 2005 056 520 | A1 | 5/2007 |
| EP | 1 930 583 | A1 | 6/2008 |
| JP | 58-133482 | A | 8/1983 |
| JP | 63-212772 | A | 9/1988 |
| JP | 08-068374 | A | 3/1996 |
| JP | 2006-220091 | A | 8/2006 |
| JP | 2006-242034 | A | 9/2006 |
| WO | 2004/001221 | A1 | 12/2003 |
| WO | 2006/103505 | A1 | 10/2006 |

* cited by examiner $E_0$ - energy lost in the quartz window
$E_W$ - energy supplied to the dumper
$E_P$ - energy dissipated in the gas cushion
$E$ - energy of the laser pulse

LASER IGNITION DEVICE FOR COMBUSTION ENGINE

TECHNICAL FIELD

It is the object of the invention to provide a laser ignition device for a combustion engine, especially a four-stroke engine, powered by ethyl alcohol, methyl alcohol and petrol, kerosene and benzol (benzene).

BACKGROUND ART

A laser ignition device is known for a combustion engine, according to the Japanese application No. JP20050056267, where on the cylinder head, in its symmetry axis, between the exhaust valve and the suction valve, a multibeam laser in a housing is mounted. In the bottom of the laser housing a series of windows is positioned, through which the laser rays are directed to penetrate into the combustion chamber above the piston, to ignite the fuel mix generated inside the combustion chamber during the suction stroke from the sucked air and the fuel injected by the injector positioned close to one of the valves at an acute angle to the cylinder axis and also at an acute angle to the axis of the adjacent valve. The bottom of the piston also has a recess that constitutes a spherical bowl. The laser is coupled with a control system. Ignition is caused directly by the laser rays that penetrate the space filled with the mixture of fuel and air, at diverse points determined by the positioning of the multibeam laser windows.

Also a laser ignition is known, for a combustion engine, according to another Japanese application No. JP 20050056358, where in the cylinder head, in its axis, between the exhaust valve and the suction valve, a laser housing tube is mounted with a lens system inside and a window at the end. A divided mirror is positioned above the lens system. Control and operation modules are connected to the laser, injector and the suction valve, where the operation module comprises: a laser actuating element, a system for capturing reflected rays, and a system for recording operation irregularities, and the control module comprises the following systems: a laser emission control module, a combustion process monitoring module, and a module for control of the suction valve and the injector. A combustion process monitoring module is connected with cylinder pressure and the connecting-rod angle sensors. The bottom of the piston has a recess in a form of a spherical bowl, and the injector is positioned between the laser housing pipe and the suction valve, at an acute angle to the cylinder axis. The laser rays enter the combustion chamber above the piston, said chamber being filled with a fuel mix obtained from the injected fuel and sucked air during the suction stroke. Ignition is directly caused by a laser ray penetrating the space filled with the mixture of the fuel with air.

A laser ignition instrument is also known for a combustion engine, according to the U.S. Pat. No. 4,416,226, which instrument is built-in with its operation part on the cylinder head at an acute angle relative to the cylinder axis. A stepped sleeve is screwed into the cylinder head, and a further sleeve with a short outer thread is screwed thereinto. In each of the two sleeves, in appropriate seats a lens optic system is mounted, said system comprising a biconvex focusing lens, built in at the end of the sleeve, close to the combustion chamber of the cylinder, and further on, towards the main housing of the pulse laser, there is a plano-convex lens and a biconcave lens are mounted, both of them being embedded in seats with a clearance that accommodates expansion of the lens material. The instrument is connected with a computing module operative basing on the received data concerning the combustion process, ignition setup process and the thermodynamic circulation process in the engine, where the output data from the module flow to a second control module directly connected with a laser, and in this manner the laser operation is performed, in reply to specific signals that characterize the engine operation. Ignition of the fuel mixture is caused directly by a laser beam focused by the lens system at a specific point—a focus within the space of the cylinder combustion chamber.

There is also known a combustion engine and a method of operation a combustion engine with the use of a laser ignition, according to the German patent specification DE 102005056520, also filed under the PCT as WO2006EP66747. In the engine, the fuel injector is built-in within the cylinder head in the cylinder axis or at an acute angle to the axis, and the laser housing us similarly constructed, save that if the laser is positioned at an angle to the cylinder axis, then the injector is positioned centrally, and vice versa. The piston crown has a cavity of a flat base the plane of which 1.5 is perpendicular to the cylinder axis, and the periphery of the cavity is sloped towards outside. In other embodiments the cavity has a centrally positioned hump having an outline of a spherical bowl or the hump is shifted to the left from the cylinder axis or to the right slightly off the axis, and yet in another embodiment, the bottom of the cavity is sloped relative to the cylinder axis, at an angle greater than 90° with the hump aligned with the cavity axis. Correspondingly to the variable shape of the cavity in the bottom of the piston, varies the outline of the space that accommodates the fuel mix: a cake outline, a flat hat outline at the hump aligned with the cavity axis, and a cake outline with a rise at the hump shifted to the left, while with the hump shifted to the right, slightly off the cylinder axis, the outline reminds a shape of a motor car in the cross-section. The injector, suitably to the shape of the outlet: a ring, several outlets for individual streams distributed for example on a circle or in coaxial circles, provides a temporarily variable space comprising the fuel mix. A laser with an end comprising a concave-convex lens generates rays that are converged at a focus positioned always within the space comprising the fuel mix, at a distance from the material of the piston bottom. Ignition is caused directly by the laser ray.

DISCLOSURE OF INVENTION

The laser ignition device for a combustion engine, in particular a four-stroke engine, powered by ethyl alcohol, methyl alcohol and petrol, kerosene or benzol (benzene), according to the invention, is characterized in that it is provided with a dumper fixed at the bottom of the engine cylinder piston, preferably having a circular shape of the part extending above the plane of the bottom of the piston, where the dumper is made of tungsten, tantalum or platinum, and the extent at which the plane of the bottom of the piston projects upwards is not less than 0.5 mm, and the diameter of the flat, matted operation surface of the dumper, perpendicular to the axis of the laser beam, is not less than the double diameter of the beam, and moreover at the outlet of the slidable sleeve of the laser housing, a window is positioned, said window being made of a transparent material resistant to the temperature, pressure and changes thereof in the engine combustion chamber, preferably made of transparent quartz, and moreover the laser is positioned in the cylinder axis or close to it, but in a manner so that the laser beam is parallel to the cylinder axis.

In another embodiment, the dumper is fixed at the junction of two arms of a steel material, attached to the outer sleeve of the laser housing, where in the front view the arms have an outline of slightly curved bows with a pass at the base for accommodating the dumper or an even-armed trapezoid outline, and moreover the laser is positioned in the cylinder axis or close thereto, also at a angle to it, where the laser housing is slidably fitted into the outer sleeve fixed in the cylinder head, while the remaining construction remains unchanged.

The use, in the laser ignition device, of a dumper allows for indirect ignition of the mix from the operation surface of the dumper, and not directly from the laser ray. The exposed area of the operation surface of the dumper is heated during the laser beam pulse to a temperature that ensures ignition of the overflowing fuel mix, and the possibility to adjust the distance between the dumper and the quartz window, seated in the slidable sleeve (thickness "d" of the gas cushion) allows for full control of the laser radiation beam entering the cylinder. The laser ignition in a four-stroke combustion engine has one more important advantage: it makes it possible to use as the fuel kerosene and benzol (benzene) which normally, in a compression-ignition engine, are not suitable due to their self-ignition temperature.

BRIEF DESCRIPTION OF DRAWINGS

The object of the invention, in an embodiment, is explained in the drawing where FIGS. 1 and 2 illustrate schematically mounting of the control-operation system, while

MODES FOR CARRYING OUT THE INVENTION

Figure 1:
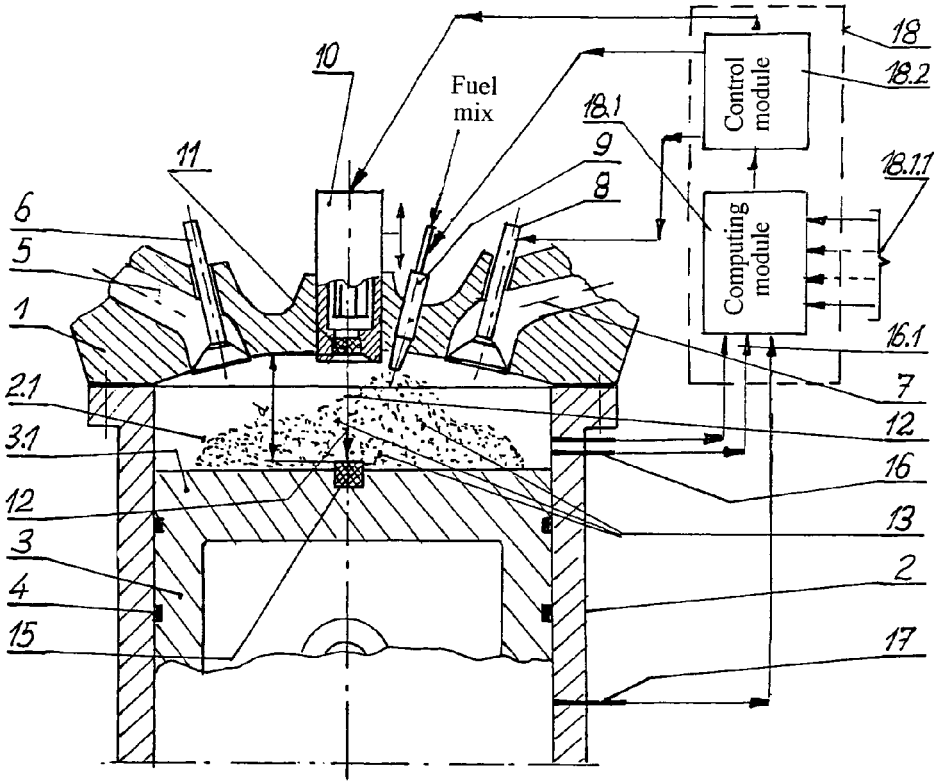
FIG. 1 is, an axial sectional simplified view of a head with a cylinder and built-in basic equipment.
Figure 2:
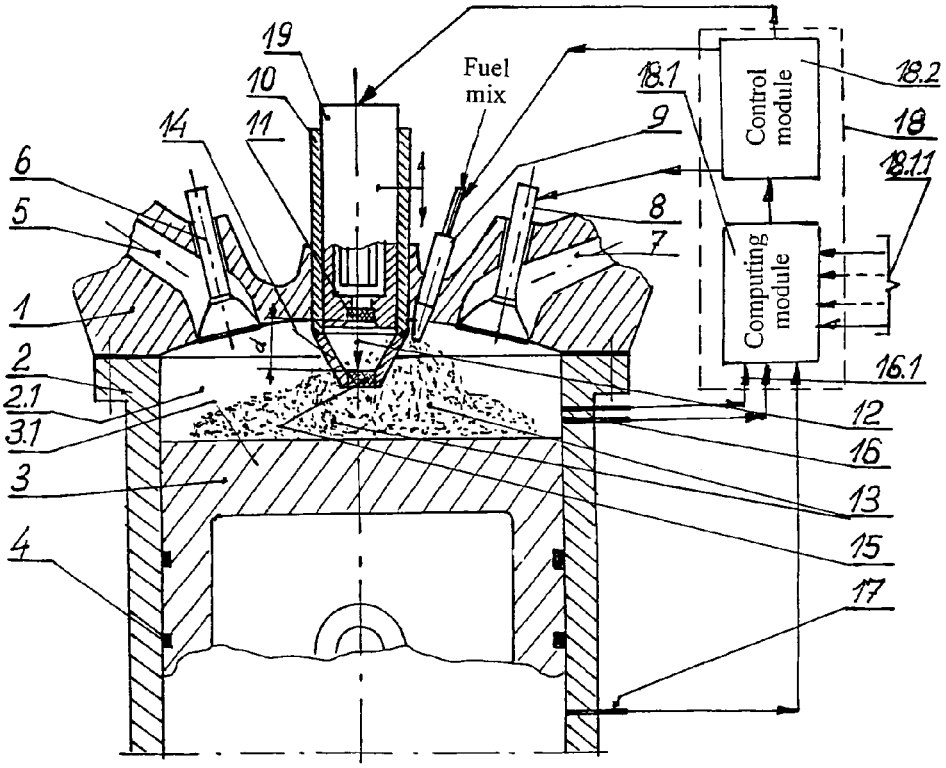
FIG. 2 is an axial sectional view of a head with a cylinder and basic equipment in another embodiment. In both cases.

The laser ignition device for a combustion engine according to the invention is constituted by a pulse laser, the housing 10 of which is installed in a manner so that the laser beam is parallel to the axis of the cylinder 2 on the head 1 of the cylinder 2 between the exhaust valve 6 and the suction valve 8. Between the laser housing 10 and the suction valve 8 a fuel injector 9 is mounted in the head 1, where injection of fuel may occur also directly into the inlet suction channel 7 by means of the injector 9 mounted thereon, upon opening of the suction valve 8. At the end of the sleeve of the laser housing 10 a window 11 of a transparent material is mounted in, said material being resistant to the temperature and pressure conditions within the combustion chamber 2.1. The piston 3 with sealing rings 4 is provided with a dumper 15 mounted in the bottom 3.1. of the piston 3. The dumper 15 has preferably a circular shape and it projects above the bottom surface 3.1 of the piston 3 for not less than 0.5 mm, where the diameter of the flat matted operation surface of the dumper, perpendicular to the axis of the laser beam, is not less than the double diameter of the beam. The fuel injector 9 injects fuel in streams that correspondingly to the kind of the outlet can vary in their pattern and they mix during the suction stroke with air sucked from the inlet suction channel 7 upon raising the suction valve 8.

Figure 3:
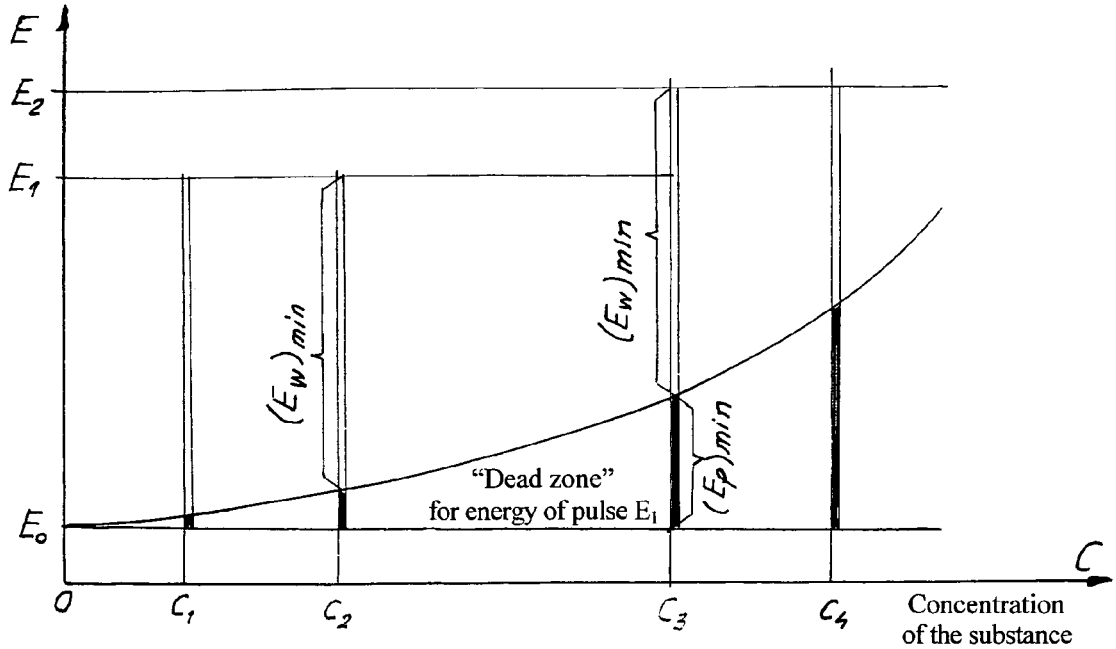
FIG. 3 illustrates in a plot the relation of the power loss of the laser radiation beam versus the concentration of the substances in the fuel mix.

The laser beam 12, after it traverses the window 11, hits the dumper 15 the operation surface of which is heated to a temperature capable to initiate ignition, and then as the concentration of the fuel increases ignition is transferred to a gas cushion between the window and the dumper. When the amount of fuel in the fuel mix reaches a level at which radiation energy loss, as defined by the Beer-Lambert-Bouguer law, causes increase in the mix temperature in the axis of the laser beam to the self-ignition point, ignition will occur in the gas cushion. A minimum laser pulse power must be such that prevents any break, "dead zone", during transition from the dumper-caused ignition to the ignition caused by self-ignition in the gas cushion upon enrichment of the mix during the engine operation, as illustrated in FIG. 3. Combustion of the fuel mix causes increase in the volume of combustion gases and pressure, which results in a movement of the piston 3 down, where in its return stroke the exhaust valve 6 is opened and the combustion gases are exhausted through the exhaust channel 5.

In another embodiment, the dumper 15 is mounted at the junction of two arms 14 fixed to the outer sleeve of the laser housing 10, in which an inner sleeve 19 with a window 11 is slidably seated, and the arms 14 have a slightly bow-like shape or together they form a even-armed trapezoid outline. In both embodiments, the laser housing 10, the injector 9 and the suction valve 8 are connected with a control-operation unit 18, also connected with a temperature and pressure sensor 16 and a fuel concentration sensor 16.1 in the combustion chamber 2.1 of the cylinder 2, as well as a sensor 17 of the angle of positioning of the shank of the connecting-rod. The control-operation system 18 comprises a computing module 18.1 of the engine circulation, receiving input data 18.1.1. as well as signals from the sensors 16, 16.1 and 17, and a control module 18.2. of the engine circulation associated with the laser which is actually controlled by it.

The device of the invention can use diverse lasers from among the known ones (ruby laser, neodymium laser, neodymium YAG laser or $CO_2$-based molecular laser, and others, including semiconductor lasers having sufficient spatial light beam coherence), but they must operate in pulses. The power of the laser must be sufficient to provide, within from 10 to 100 μs (which depends on the velocity of the engine), with consideration of the loss caused by traversing the quartz window and the gas cushion, to the operation surface of the dumper 15 enough energy so as to heat the surface to a temperature that causes self-ignition of the fuel mix at the layer close to the surface. In the case of low velocity engines, such as e.g. engines of vessels, preferably the power of the laser must be sufficient to provide to the operation surface of the dumper 15 enough energy so as to heat the surface within from 10 to 1000 μs.

During passing of the laser rays through the gas cushion between the window surface and the dumper surface, the luminous intensity is weakened as under the Beer-Lambert-Bouguer law, expressed in the following formula:

$$J=J_0e^{-\mu cd}$$

where the individual symbols have the following meanings:

$J_0$—density of the laser beam exiting the window 11, d—distance between the dumper 15 and the window 11, μ—absorption rate as per substance concentration unit, c—substance concentration.

Accordingly, the energy of the beam of the laser light transferred to the dumper 15 decreases exponentially when the amount of fuel in the mix increases, similarly as is increased exponentially the value of loss in the gas cushion, which causes increase in the temperature. The laser used in the device should be operable at with a minimum power that ensures ignition in the engine within the entire mix explosion range space, and this occurs when the dumper-caused ignition has not declined yet but self-ignition in the gas cushion has been already initiated upon increase of the amount of the fuel in the fuel mix, which means that both kinds of ignition, dumper-based ignition and self-ignition in the cushion, overlap in some operation interval. This minimum power of the laser, for a specific engine and preset distance "d", should be established by means of experimental methods, where first the "dead zone" should be found in which ignition decays, and then it is necessary to cause, by increase of the laser power, i.e. energy provided in a pulse, decay of the "dead zone". This is illustrated in the plot of FIG. 3, where in a system of coordinates E,C (energy of the laser pulse—E, concentration of the substance=amount of fuel in the mix—C) the exponential relation of the energy of the laser radiation beam versus the increase in the amount of fuel in the mix is illustrated with determination of specific values:

E—laser pulse energy $E_0$—energy lost in the quartz window $E_W$—energy supplied to the dumper $E_P$—energy dissipated in the gas cushion $(E_W)_{MIN}$—minimum energy at which self-ignition at the dumper surface occurs $(E_P)_{MIN}$—minimum energy at which self-ignition in the gas cushion occurs $C_2$—lower limit of explosion range of the mix $C_3$—amount of fuel in the mix for which self-ignition occurs simultaneously at the dumper surface and in the axis of the gas cushion upon increasing energy of the laser pulse up to $E_2$ A pulse, or a series of pulses, having a total length of 10 to 100 μs, is repeated dependently on the velocity of the engine: $n_s/2\times60$ times per second, where $n_s$—number of revolutions per minute for the engine. In the case of low velocity engines, such as e.g. engines of vessels, preferably a pulse, or a series of pulses, having a total length of 10 to 1000 μs, is employed.

The laser radiation exiting the window 11 into the combustion chamber of the cylinder 2 of the engine sweeps the surface of the quartz window 10 from impurities deposited on it.

The invention claimed is:

1. In a four-stroke combustion engine, powered by ethyl alcohol, methyl alcohol and petrol, kerosene, benzol or benzene, that includes a cylinder having a combustion chamber and an axis, a cylinder head, a fuel injector and a suction valve, a laser ignition device that comprises:

a pulse laser built-in on the cylinder head that emits a pulsed laser beam in the cylinder axis, close to the cylinder axis, or at an angle to the cylinder axis, the pulse laser comprising:

a housing including an outer sleeve and a slidable sleeve having an outlet;

a window of transparent material seated at the outlet of the slidable sleeve, wherein the material is resistant to temperature and pressure changes within the combustion chamber of the cylinder of the engine;

two arms of steel material connected to the outer sleeve of the housing; and a junction between the two arms;

a dumper fixed in the junction of the two arms and having a flat matted operation surface, wherein the flat matted operation surface comprises a diameter that is perpendicular to an axis of the pulsed laser beam, wherein the diameter of the flat matted operation surface is not less than double a diameter of the pulsed laser beam, wherein the dumper is made of tungsten, tantalum or platinum; and wherein in a front view, the two arms have an outline of slightly curved bows with a pass at the base for accommodating the dumper or an outline of an even-armed trapezoid; and a control-operation system comprising:

a computing module that is operative based on received data concerning the combustion process, an ignition setup process, and a process of thermodynamic engine circulation; and a control module that controls emission of the pulsed laser beam, the fuel injector and the suction valve.

2. The laser ignition device of claim 1, wherein said transparent material is made of transparent quartz.

3. In a four-stroke combustion engine, powered by ethyl alcohol, methyl alcohol and petrol, kerosene, benzol or benzene, that includes a cylinder having a combustion chamber, an axis and a piston, a cylinder head, a fuel injector and a suction valve, a laser ignition device that comprises:

a pulse laser built-in on the cylinder head that emits a pulsed laser beam in a manner so that the pulsed laser beam is parallel to the axis of the cylinder and either in or close to the cylinder axis, the pulse laser comprising:

a housing including a slidable sleeve having an outlet;

a window of transparent material seated at the outlet of the slidable sleeve, wherein the material is resistant to temperature and pressure changes within the combustion chamber of the cylinder of the engine;

a dumper fixed in a bottom of the piston and being made of tungsten, tantalum or platinum, wherein the dumper comprises:

a flat matted operation surface having a diameter that is perpendicular to an axis of the pulsed laser beam, wherein the diameter of the flat matted operation surface is not less than double a diameter of the pulsed laser beam; and a circular part that extends above a bottom surface of the piston, wherein the extent to which the circular part projects above bottom surface is not less than 0.5 mm; and a control-operation system comprising:

a computing module that is operative based on received data concerning the combustion process, an ignition setup process and a process of thermodynamic engine circulation; and a control module that controls emission of the pulsed laser beam, the injector and the suction valve.

4. The laser ignition device of claim 3, wherein said transparent material is made of transparent quartz.

* * * * *